US006041874A

United States Patent [19]

Lee

[11] Patent Number: 6,041,874

[45] Date of Patent: Mar. 28, 2000

[54] TUBULAR ACTUATOR COMPONENT FOR USE IN A DRILL STRING

[76] Inventor: Paul Bernard Lee, P O Box 30576, Dubai, United Arab Emirates

[21] Appl. No.: 08/945,863

[22] Filed: Apr. 28, 1998

[30] Foreign Application Priority Data

May 1, 1995 [GB] United Kingdom ..... 9508803

[51] Int. Cl.[7] ..... E21B 23/04; E21B 17/10

[52] U.S. Cl. ..... 175/101; 175/267; 175/320; 192/48.1

[58] Field of Search ..... 175/122, 231, 175/320, 267, 101, 106; 192/87.1, 87.14, 87.17, 48.1

[56] References Cited

U.S. PATENT DOCUMENTS 2,167,019 10/1939 Yost ..... 175/101

4,276,944 7/1981 Geczy ..... 175/101 X

*Primary Examiner*—David Bagnell
*Assistant Examiner*—George M. Mihalik
*Attorney, Agent, or Firm*—Workman, Nydegger & Seeley

[57] ABSTRACT

A tubular actuator component (20) for use in a drill-string is disclosed and which comprises a main tubular outer body (6) within which a clutch mechanism, mandrel (2), and pad mandrel (7) are located. The clutch mechanism comprises a lower stationay clutch component (4), secured upper clutch component (12) and an intermediate clutch component (1) such that application of fluid aetuating pressure to the interior of the tubular component axially displaces intermediate clutch member (1) between positions of co-operative engagement with one or the other of the lower stationary clutch component (4) and the secured upper clutch component (12).

8 Claims, 8 Drawing Sheets

TUBULAR ACTUATOR COMPONENT FOR USE IN A DRILL STRING

This invention relates to a tubular actuator component for use in a drill string, and which includes a clutch mechanism which is operable under fluid pressure action e.g. a differential pressure action, between an inoperative position and an operative position to actuate a drill-string related component.

The invention has been developed primarily in connection with a tubular actuator component for controlling the diameter of an adjustable stabiliser mechanism of a drill-string. However, it should be understood that this is just a preferred example of a drill-string related component whose operation can be controlled by the tubular actuator component according to the invention.

According to the invention there is provided a tubular actuator component for use in a drill-string and which includes a tubular body, and a clutch mechanism mounted in said tubular body and which is operable under fluid pressure action between an inoperative position and an operative position to actuate a drill-string related component, said mechanism comprising:

a first clutch member which is secured to said tubular body;

a second clutch member axially spaced from said first clutch member and also secured to said tubular body; and an intermediate clutch member which is rotatably mounted in said tubular body and which is axially displaceable, upon application of fluid actuating pressure to the interior of the tubular component, between positions of co-operative engagement with one or the other of said first and second clutch members, thereby to actuate a drill-string related component when the latter is coupled with said tubular actuator component.

In a preferred embodiment, the drill-string related component comprises an adjustable stabiliser mechanism of a drill-string and coupled with said tubular actuator component.

Alternatively, the drill-string related component may comprise an under reamer having a plurality of extendable reamer arms.

In a preferred embodiment, the mechanism further comprises an internal member axially displaceable upon application of fluid actuating pressure relative to the tubular member, and the intermediate clutch member is rotatably mounted to the internal member.

The intermediate clutch member may comprise respective engaging means for engaging corresponding engaging means on one or the other of said first and second clutch members.

In a preferred embodiment, the engaging means on said first clutch member comprises a plurality of recesses separated by inclined surfaces, and the engaging means on said intermediate clutch member comprises corresponding first projections for location in said recesses.

In a preferred embodiment, the or each inclined surface comprises first and second inclined portions separated by a stop means.

Preferably, the engaging means on the second clutch member comprises a plurality of recesses for receiving corresponding second projections provided on the intermediate clutch member, and adjacent pairs of said recesses are separated by respective inclined surfaces.

Preferred embodiments of tubular actuator component according to the invention will now be described in detail, by way of example only, with reference to the accompanying drawings, in which.

Figure 4:
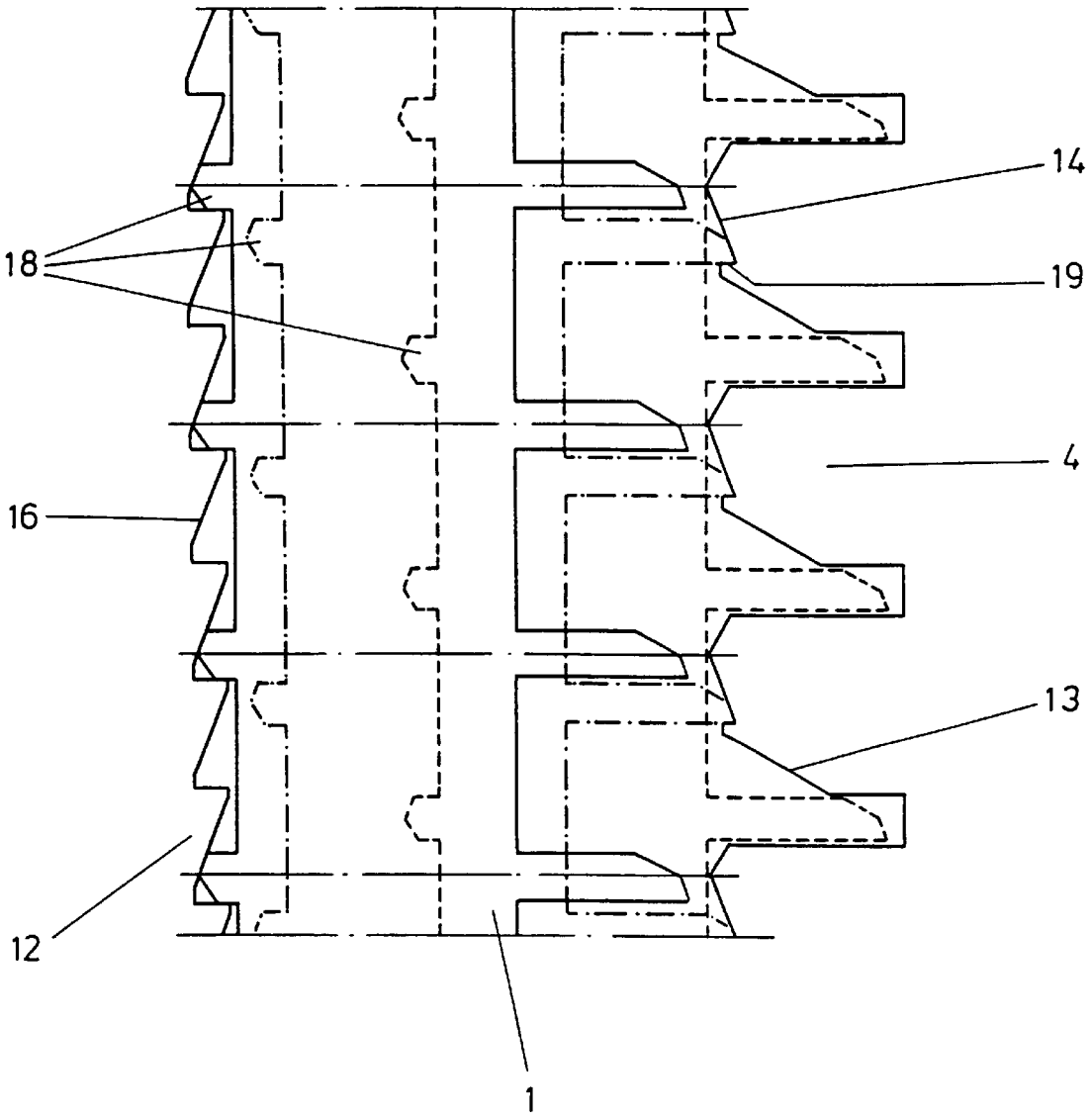
FIG. 4 is a detail and enlarged view showing the interaction between the components of the clutch mechanism.
Figure 4A:
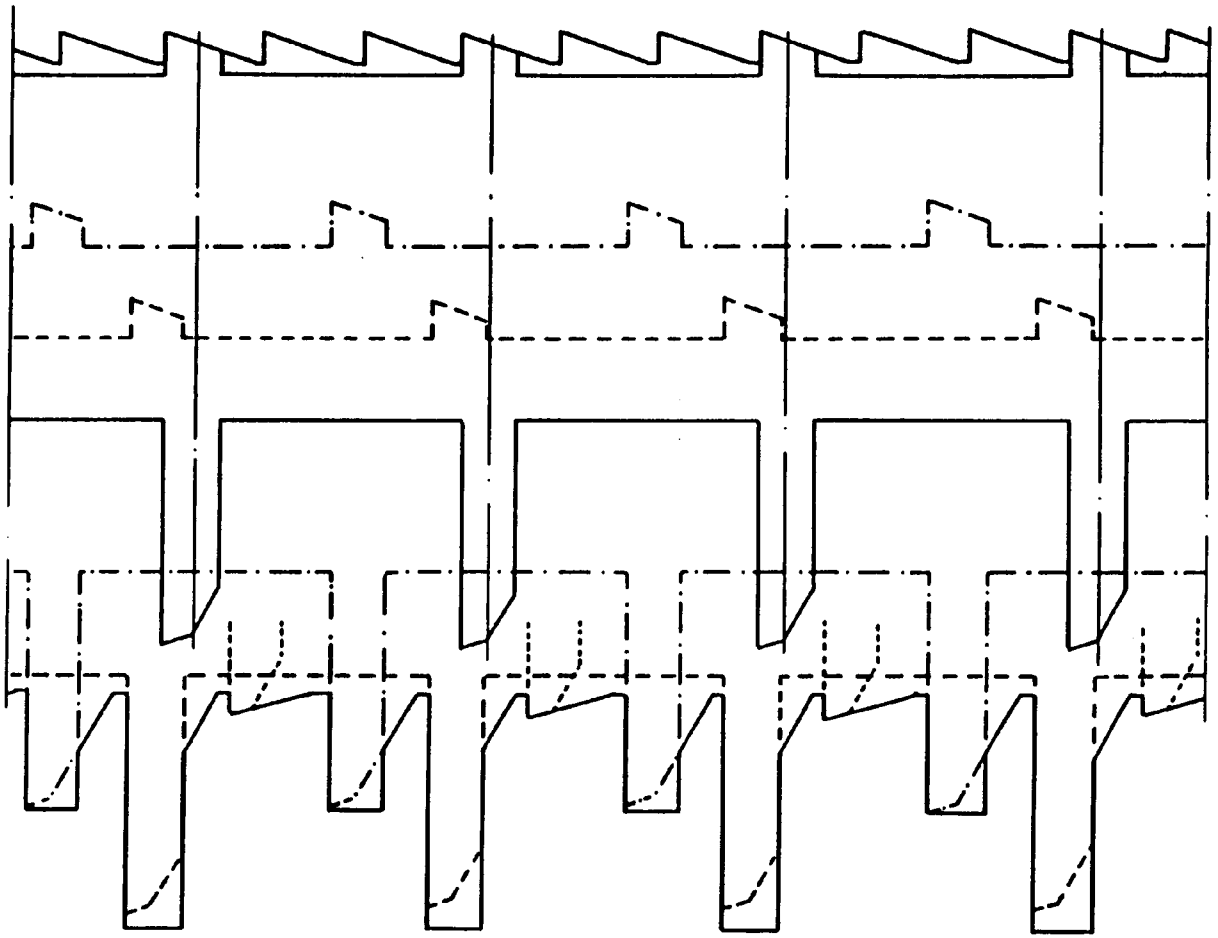
Figure 5:
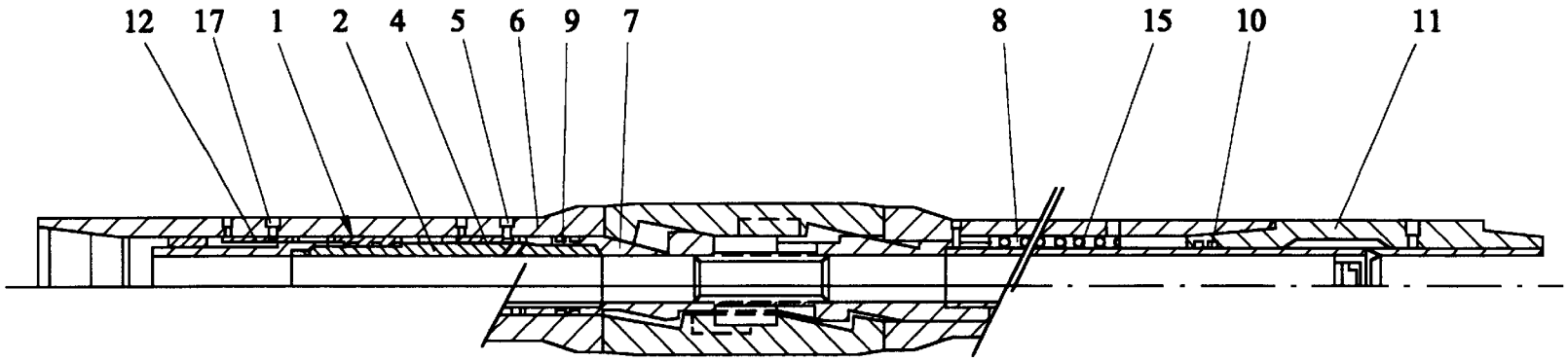
Figure 5A:
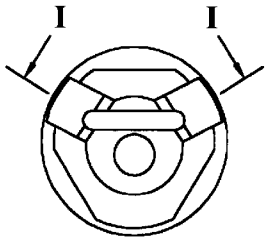
Figure 5B:
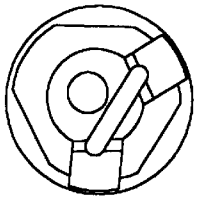
Figure 5C:
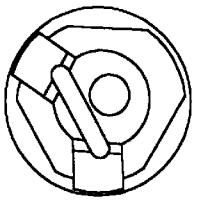
Figure 5D:
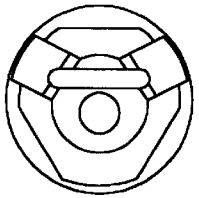
Figure 5E:
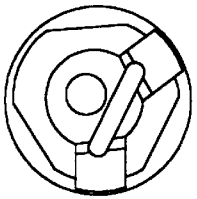
Figure 5F:
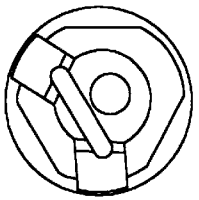
Figure 5G:
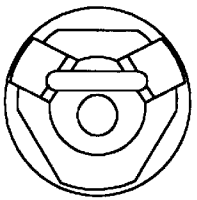
Figure 5H:
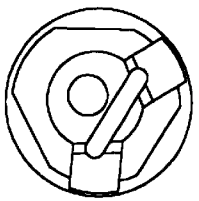
Figure 6:
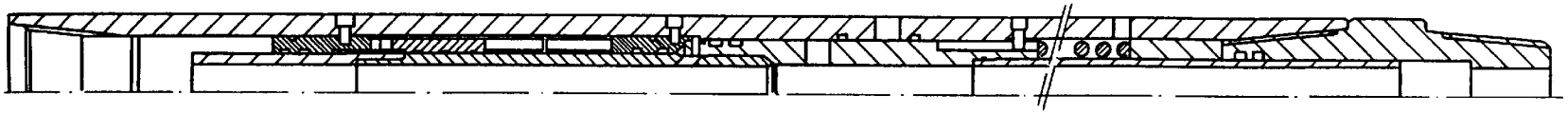
Figure 7:
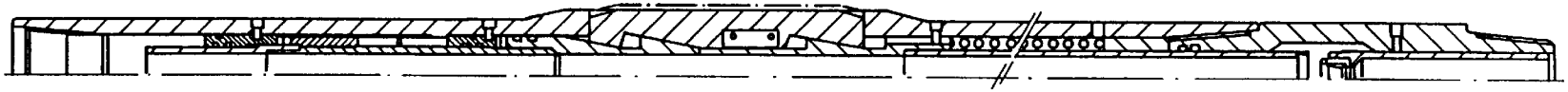
Figure 8:
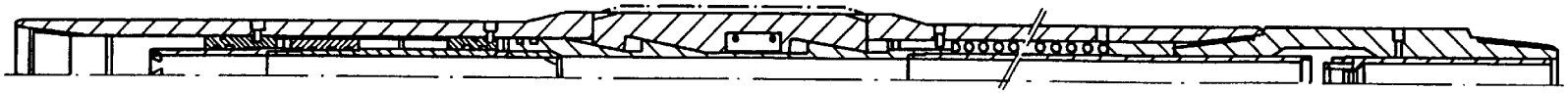
Figure 9A:
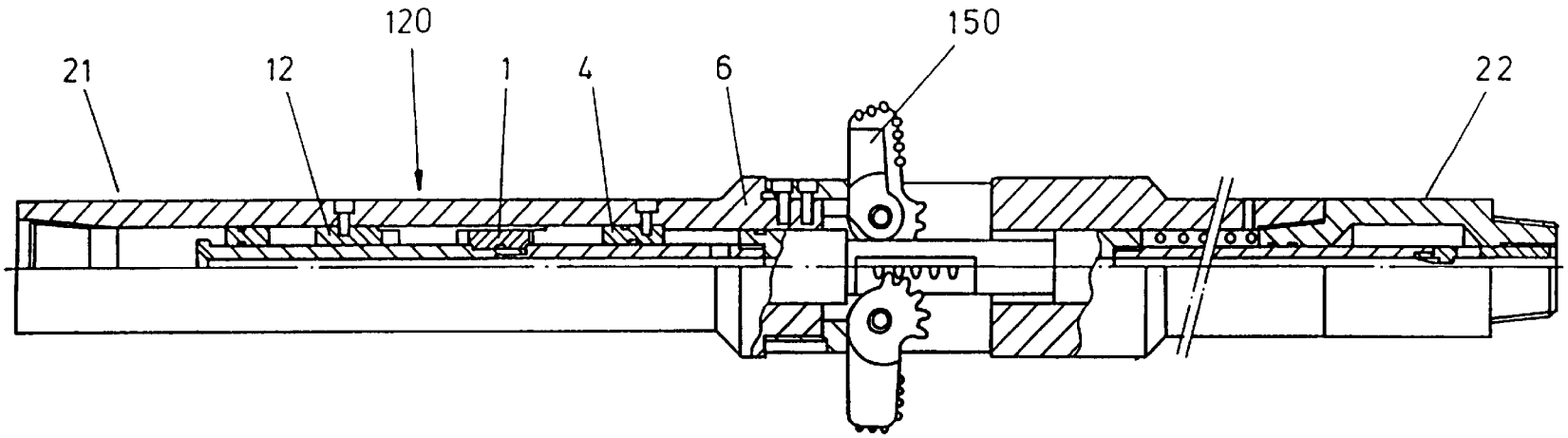
Figure 9B:
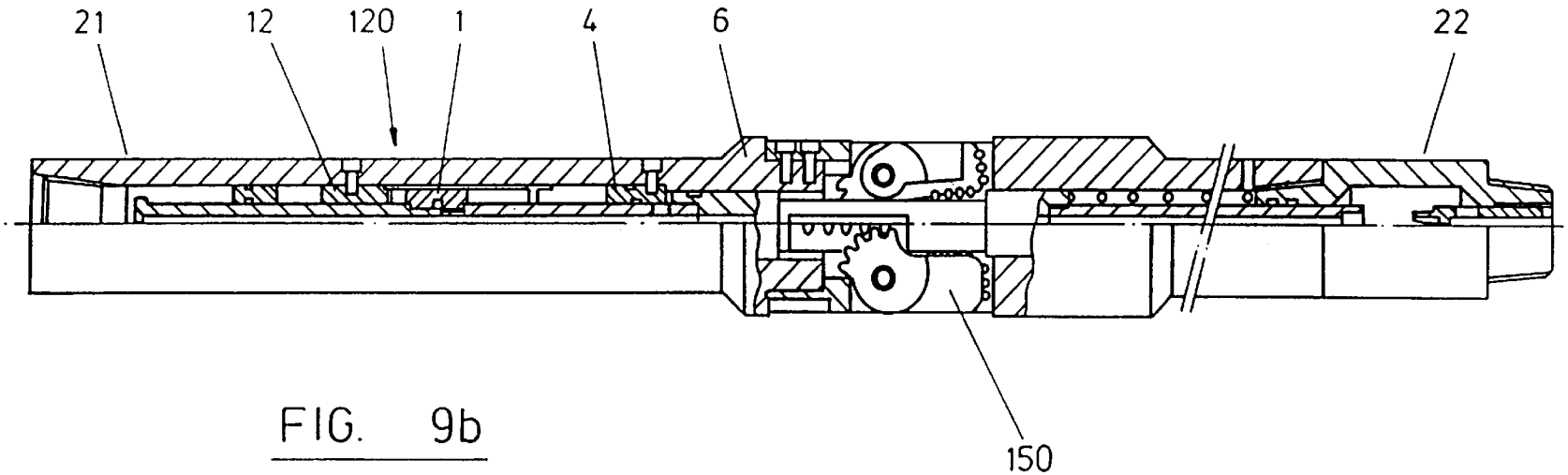
Figure 10:
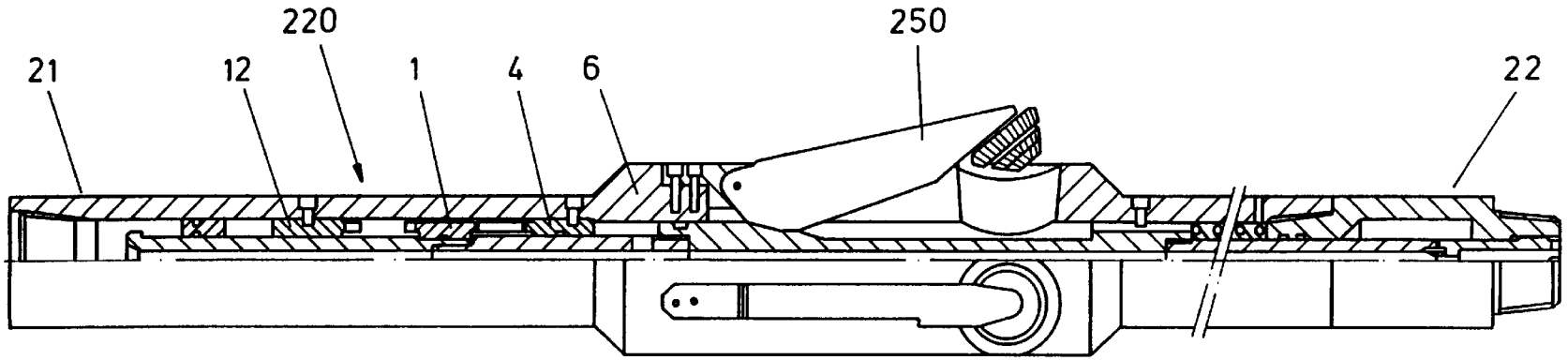
Figure 11:
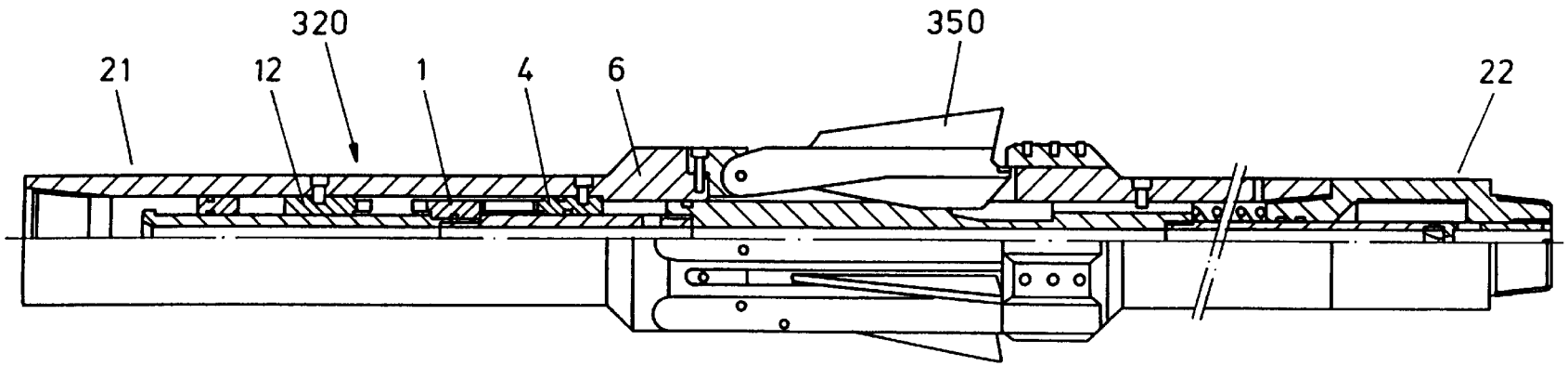

FIG. 4*a* is a detail and enlarged view, similar to FIG. 4, showing an alternative type of interaction between the components of the clutch mechanism;

FIG. 5 is a longitudinal sectional view of a further embodiment of tubular actuator component according to the invention;

FIGS. 5(*a–h*) are sectional illustrations of the component being used to operate a left/right tool at the end of the drill-string and with FIGS. 5(*a–d*) showing sectional views of the positions taken up during a left hand turn, and FIGS. 5–5*b* showing the positions taken up by the components during a right hand turn;

FIGS. 6, 7 and 8 are respective longitudinal sectional views of further embodiments of tubular actuator component according to the invention; and FIGS. 9, 10 and 11 are longitudinal sectional views of further embodiments of tubular actuator components of the invention.

Referring now to FIGS. 1 to 4 of the drawings, there is shown a preferred embodiment of tubular actuator component which is intended to be mounted in and form part of a drill-string, and which includes a clutch mechanism which is operable by a pressure differential action between an inoperative position and an operative position in which it can actuate a drill-string related component.

The preferred tool or drill-string related component with which the tubular actuator component can be used is an adjustable stabiliser mechanism, and in which the actuator component can be used to control the diameters of the stabiliser mechanism.

In the oil/gas drilling Industry, it is often necessary to activate "down hole" tools via many different types of mechanisms, and the tubular actuator component of the invention is an example which can be actuated by pressure differential action.

Figure 1:
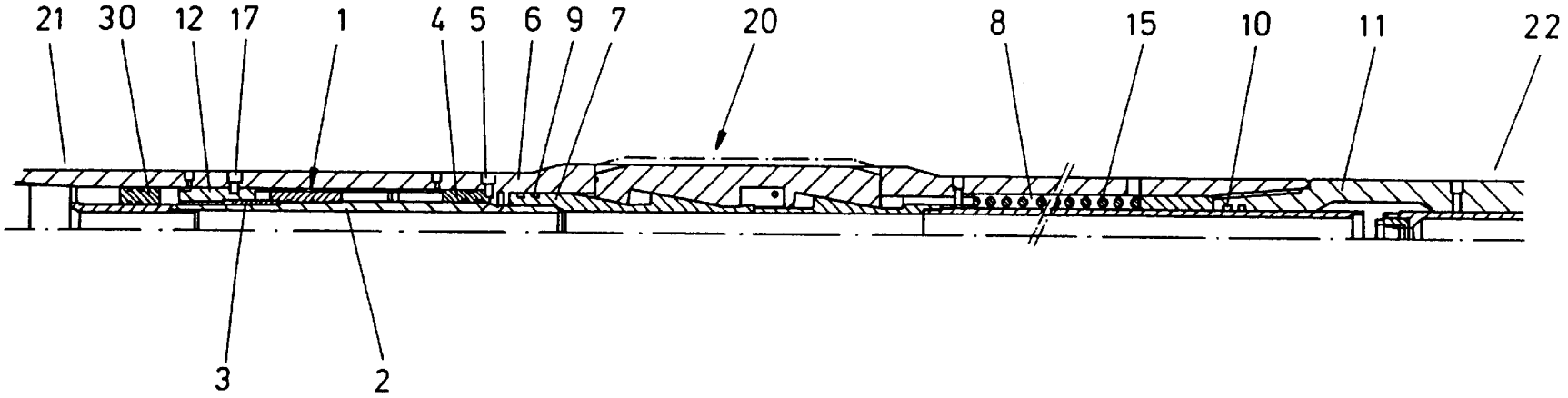
FIG. 1 is a longitudinal section of a tubular actuator component according to the invention, for use in a drill-string.
Figure 2:
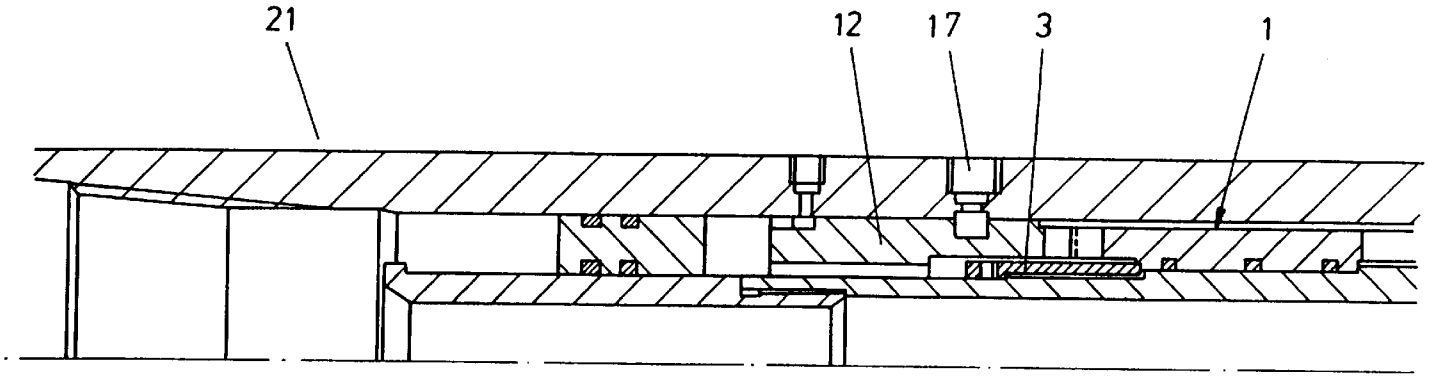
FIG. 2 is an enlarged view of the upper end of the component shown in FIG. 1.
Figure 3:
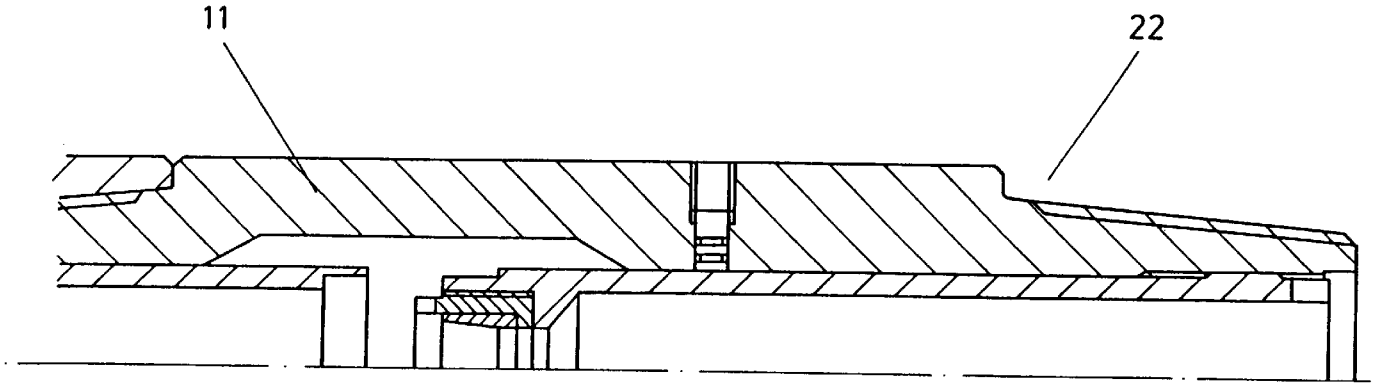
FIG. 3 is an enlarged view of the lower end of the component shown in FIG. 1.

Referring in particular to FIG. 1, this is a longitudinal sectional view of a tubular actuator component according to the invention, which is designated generally by reference 20, of which the upper end is shown by reference 21 and the lower end by reference 22, and in which upper and lower ends 21 and 22 are shown in more detail in FIGS. 2 and 3 respectively. The tubular component 20 can be incorporated in a drill-string in any known manner, and forms a component part thereof, during normal operation of the drill-string. The tubular component 20 comprises a main tubular outer body 6, within which are mounted the three separate components of a clutch mechanism, and also a mandrel 2, and a pad mandrel 7 coupled therewith by a threaded interconnection. The clutch mechanism comprises a lower stationary clutch component 4, a secured upper clutch component 12, and an intermediate clutch component 1 which is rotatably mounted within the assembly. The clutch mechanism is lubricated with oil with use of a floating piston.

The intermediate clutch component 1 is secured to the mandrel 2 by a retainer ring 3, which allows the clutch component 1 to rotate on the mandrel 2, but which limits the longitudinal movement of the clutch component 1 on the mandrel 2. Lower clutch component 4 is secured in position by a lock pin 5 which locks clutch component 4 to the main body 6, and also by a shoulder on the main bore of the main body 6. As indicated above, the mandrel 2 is joined to pad mandrel 7 by a threaded inter-connection, and therefore when mandrel 7 moves under differential pressure action, so also will the mandrel 2 move.

Pressure differential action can be applied to the mandrel 7, being created by an annular chamber 8 which is sealed from internal pressure by seals 9 provided on the pad mandrel 7, and seals 10 on bottom sub 11.

When pressure is applied to the system, the clutch mechanism which is fitted on the mandrel 7 moves downwardly, thereby pulling mandrel 2 and intermediate clutch component 1 down into contact with the lower clutch component 4 in either the extended position, or the retracted position.

The co-operation between the clutch components 1, 4 and 12 can be seen in more detail in FIG. 4.

As can be seen in FIG. 4, clutch component 4 has two inclined planes 13, 14, and which serve to track the clutch component 1 into position. The clutch component 1 rotates with a downward force from pad mandrel 7 and under the differential pressure acting on the pad mandrel 7. When the pressure is equalised between the drill pipe and the "annulus", spring 15 pushes the pad mandrel 7 and the mandrel 2 (and also the rotating clutch component 1) upward until rotating clutch component 1 contacts the upper clutch component 12. It then moves over inclined surfaces 16 on the lower face of the upper clutch component 12, with the upper clutch component 12 being secured to main body 6 by lock pin 17, and also by the shoulder on the main body 6.

When the rotating clutch component 1 contacts the upper (fixed) component 12, the inclined plane 18 on the rotating clutch component 1 contacts the inclined surface 16 on the upper clutch component 12. When pressure is increased in the drill-string again, the pad mandrel 7 pulls the mandrel 2 and the rotating clutch component 1 down again. The rotating clutch component then contacts the lower clutch component 4 via inclined plane 14 and the stop 19 limits the downward movement of the pad mandrel 7.

In the system described above and shown in the drawings, inward movement of the pad mandrel 7 is controlled by increasing and equalising the pump pressure or pressure differential. However, this system could be changed by inverting the clutch mechanism, so that upon pressurising up within the drill-string, the mandrel moves down and when the pressure equalises the mandrel returns to one position, and when the pumps are cycled again, the mandrel stops in another position.

In FIG. 4 of the drawings, there is shown a two position clutch which is engaged in one position, and an alternative embodiment is illustrated in FIG. 4*a*. This shows a clutch having an intermediate position, and a total of three possible position settings which can be obtained by changing the geometry of the clutch members of the clutch mechanism.

Referring now to FIG. 5 of the drawings, this is a longitudinal sectional view of a further embodiment of tubular actuator component according to the invention, and taken on section line I—I in FIG. 5*a;*

FIGS. 5(*a–h*) show, respectively, positions taken up by the components during left hand turning and right hand turning of a steerable tool coupled with the actuator component, and parts corresponding with those already described are given the same reference numerals.

A left/right turning tool is not intended to take the place of steerable systems as such, but have major application in tangent sections, or sections where inclination control and turn are required to maintain a proposed well plan. This would normally be utilised in 12¼ inch and 8½ inch hole sections. Another application would be for horizontal wells, where inclination control and azimuth could be controlled while carrying out rotary drilling.

Referring now to FIG. 6, this shows the novel clutch mechanism of the tubular actuating actuator component according to the invention incorporated into a different type of tool. In this configuration, the clutch can be sealed in oil, or can run in mud.

When the clutch is actuated, and locked in the upper position, with small downward travel, the ports are sealed and do not align; by kicking the pumps out and in again, the clutch moves to the lower position so that the ports then align. The mandrel can bottom-out in the bottom sub, or on the clutch component.

With this tool, it is possible to open and close ports using pressure action to actuate the clutch mechanism, as described above with reference to FIGS. 1 to 4. However, this system will also work in the same way as the system which will be described in more detail below, with reference to FIG. 8, which uses flow velocity i.e. nozzle action, rather than a pressure differential.

FIG. 7 illustrates a similar type of tool to FIG. 1, but incorporating some detailed changes. Thus, in FIG. 1, a floating piston 30 is provided to seal the clutch assembly in oil. This is a "floating" piston to allow for oil pressure equalisation internally. The system in FIG. 1 seals oil between the floating piston and seals on the lower clutch component 4. The intermediate clutch element 1 moves backwards and forwards in an oil environment.

By contrast, in FIG. 7, the floating piston is removed, and the clutch mechanism is then exposed to drilling fluid pressure which enters from the annulus and through the annular port. Pump pressure is sealed, and does not communicate to the annular port, because of the seals on the upper and lower clutch sealing on the upper mandrel 2.

FIG. 8 illustrates a further embodiment of tool which can be actuated by a tubular actuator component according to the invention incorporating the novel clutch mechanism.

In this arrangement, the clutches can be sealed in oil, or mud. The clutches can have two set positions, or multiple set position. The difference in this system is that it does not rely on pressure differential and area giving a downward force i.e. via annular chamber 8 in FIG. 1.

In FIG. 8, the lower annular port is plugged, and the lower seals 10 are removed. A seal is added on the lower end of the mandrel above the guide pin and key way, and the annular port is moved to just below the three blades. With mandrel seals on the same diameter, there is no hydraulic force on the mandrel pushing it down. Pump pressure therefore can get in around the spring 15. This configuration relies on the pressure drop, or pressure on one side of a restriction, being greater than on the lower side of the restriction. With a nozzle placed anywhere along the mandrel, it will restrict the flow of fluid, causing the pressure above the nozzle to be greater than the pressure below the nozzle, and consequently moving the mandrel downwards.

This type of arrangement will be extremely effective during operations in which hydrostatic pressure downhole can vary i.e. under balanced drilling, or drilling with nitrogen, or foam. This type will work on the pressure drop across the nozzle or nozzles, and the velocity of the fluid/gas going through the nozzle.

Referring to FIGS. 9 to 11, in which parts common to the embodiment of FIG. 1 are designated by like reference numerals, under reamers 120, 220, 320, as will be known to persons skilled in the art, are designed to run through a hole of small diameter and then be actuated to open the hole up to a larger diameter when required, and comprise reamer arms 150, 250, 350 which can be displaced outwards relative to the main body 6 when actuated to engage the internal walls of the hole. FIG. 9*a* shows the arms 150 in an extended operative position, and FIG. 9*b* shows the arms in a retracted inoperative position.

Using the clutch mechanism described with reference to FIGS. 1 to 8, and which will therefore not be described in further detail, when the pumps are on the arms 150, 250, 350 can be retained inwardly relative to the main body 6 since the movement of the actuation mandrel is controlled. This allows operators of the drill-string to drill ahead with the under reamer arms held inwardly, while still maintaining maximum pump pressure for drilling. To start under reaming, the pumps are kicked out, kicked in and the under reamer mandrel then shifts to actuate the arms 150, 250 , 350, in a similar manner to that in which the stabiliser blades of the stabiliser mandrel of FIG. 1 are actuated.

Surface induction created by the flow restrictor is also useful during under reamer operations, i.e. there is lower pump pressure when the tool is not activated, and higher pump pressure when the tool is activated, in a manner similar to that of the stabiliser of FIG. 1.

It will be appreciated by persons skilled in the art that the above embodiments have been described by way of example only, and that various alterations and modifications are possible without departure from the scope of the invention as defined by the appended claims.

I claim:

1. A tubular actuator component for use in a drill-string, the component including a tubular body, and a clutch mechanism mounted in said tubular body and which is operable under fluid pressure action between an inoperative position and an operative position to actuate a drill-string related component, said mechanism comprising:

a first clutch member which is secured to said tubular body;

a second clutch member axially spaced from said first clutch member and also secured to said tubular body; and an intermediate clutch member which is rotatably mounted in said tubular body and which is axially displaceable, upon application of fluid actuating pressure to the interior of the tubular component, between positions of co-operative engagement with one or the other of said first and second clutch members, thereby to actuate a drill-string related component when the latter is coupled with said tubular actuator component.

2. A tubular actuator component according to claim 1, wherein the drill-string related component comprises an adjustable stabiliser mechanism of a drill-string.

3. A tubular actuator component according to claim 1, wherein the drill-string related component comprises an under reamer having a plurality of extendable reamer arms.

4. A tubular actuator component according to claim 1, wherein the mechanism further comprises an internal member axially displaceable upon application of fluid actuating pressure relative to the tubular member, and wherein the intermediate clutch member is rotatably mounted to the internal member.

5. A tubular actuator component according to claim 1, wherein the intermediate clutch member comprises respective engaging means for engaging corresponding engaging means on one or the other of said first and second clutch members.

6. A tubular actuator component according to claim 5, wherein the engaging means on said first clutch member comprises a plurality of recesses separated by inclined surfaces, and the engaging means on said intermediate clutch member comprises corresponding projections for location in said recesses.

7. A tubular actuator component according to claim 6, wherein the or each inclined surface comprises first and second inclined portions separated by a stop means.

8. A tubular actuator component according to claim 5, wherein the engaging means on the second clutch member comprises a plurality of recesses for receiving corresponding second projections provided on the intermediate clutch member, and wherein adjacent pairs of said recesses are separated by respective inclined surfaces.

* * * * *